US010629421B2

(12) United States Patent
Yim et al.

(10) Patent No.: US 10,629,421 B2
(45) Date of Patent: Apr. 21, 2020

(54) IONIZATION MASS SPECTROMETRY METHOD AND MASS SPECTROMETRY DEVICE USING SAME

(71) Applicants: KOREA RESEARCH INSTITUTE OF STANDARDS AND SCIENCE, Daejeon (KR); KOREA RESEARCH INSTITUTE OF BIOSCIENCE AND BIOTECHNOLOGY, Daejeon (KR)

(72) Inventors: Yong-Hyeon Yim, Daejeon (KR); Sung Woo Heo, Daejeon (KR); Hyoung Jun Lee, Incheon (KR); Ji-Seon Oh, Daejeon (KR); Byoung Chul Park, Daejeon (KR); Jeong Hee Moon, Daejeon (KR); Sung Goo Park, Daejeon (KR); Jeong Hoon Kim, Daejeon (KR)

(73) Assignees: KOREA RESEARCH INSTITUTE OF STANDARDS AND SCIENCE, Daejeon (KR); KOREA RESEARCH INSTITUTE OF BIOSCIENCE AND BIOTECH, Daejeon (KR)

( * ) Notice: Subject to any disclaimer, the term of this patent is extended or adjusted under 35 U.S.C. 154(b) by 0 days.

(21) Appl. No.: 15/779,349

(22) PCT Filed: Oct. 25, 2016

(86) PCT No.: PCT/KR2016/011992
§ 371 (c)(1),
(2) Date: Sep. 18, 2018

(87) PCT Pub. No.: WO2017/090895
PCT Pub. Date: Jun. 1, 2017

(65) Prior Publication Data

US 2019/0006163 A1 Jan. 3, 2019

(30) Foreign Application Priority Data

Nov. 25, 2015 (KR) ..... 10-2015-0165636

(51) Int. Cl.
*H01J 49/04* (2006.01)
*H01J 49/26* (2006.01)
(Continued)

(52) U.S. Cl.
CPC ..... *H01J 49/0454* (2013.01); *H01J 49/0031* (2013.01); *H01J 49/04* (2013.01);
(Continued)

(58) Field of Classification Search
None
See application file for complete search history.

(56) References Cited

U.S. PATENT DOCUMENTS 5,192,865 A * 3/1993 Zhu ..... H01J 49/04 250/281
5,345,079 A 9/1994 French et al.
(Continued)

FOREIGN PATENT DOCUMENTS

EP 0432992 A1 * 6/1991 ..... A61M 15/0085
EP 0432992 B1 * 8/1993 ..... A61M 15/0085
(Continued)

OTHER PUBLICATIONS

International Search Report of PCT/KR2016/011992, which is the parent application and its English translation—4 pages (dated Jan. 19, 2017).
(Continued)

*Primary Examiner* — Andrew Smyth
(74) *Attorney, Agent, or Firm* — Knobbe Martens Olson & Bear LLP

(57) ABSTRACT

A mass spectrometry device includes a sample seating part including an ultrasonic vibrator having a through hole
(Continued)

through which liquid particles formed by the ultrasonic vibrator from an adsorbent material including a sample and a solvent are discharged, the adsorbent material being seated on the ultrasonic vibrator; a reaction part in which plasma or an ionization medium generated by plasma come into contact with the liquid particles discharged from the through hole to form an ionized material; an introduction part discharging and introducing the ionized material to a detection part; and the detection part analyzing the ionized material discharged from the introduction part. The mass spectrometry device and the mass spectrometry method can detect the components of various samples by converting a sample into liquid particles using ultrasonic waves and applying plasma and can detect samples in various fields without regard to locations.

10 Claims, 9 Drawing Sheets

(51) Int. Cl.
*H01J 49/00* (2006.01)
*H01J 49/10* (2006.01)

(52) U.S. Cl.
CPC ..... *H01J 49/0495* (2013.01); *H01J 49/26* (2013.01); *H01J 49/105* (2013.01)

(56) References Cited

U.S. PATENT DOCUMENTS

| | | | | |
|---|---|---|---|---|
| 5,753,910 | A * | 5/1998 | Gourley | H01J 49/145 250/281 |
| 2007/0278400 | A1* | 12/2007 | Schurenberg | G01N 1/2813 250/288 |
| 2009/0159794 | A1* | 6/2009 | Schleifer | H01J 49/044 250/288 |
| 2013/0082172 | A1 | 4/2013 | Syage et al. | |

FOREIGN PATENT DOCUMENTS

| | | | |
|---|---|---|---|
| JP | 2004-233061 | A | 8/2004 |
| JP | 2014-209066 | A | 11/2014 |
| KR | 10-2005-0113890 | A | 12/2005 |
| KR | 10-2009-0118501 | A | 11/2009 |
| KR | 10-2015-0036562 | A | 4/2015 |

OTHER PUBLICATIONS

Extended European Search Report of corresponding European Patent Application No. 16868794.5—9 pages (dated Jun. 14, 2019).
Fassel et al., "Ultrasonic nebulization of liquid samples for analytical inductively coupled plasma-atomic spectroscopy: an update", Spectrochimica Acta, vol. 41B, No. 10—26 pages (1986).

* cited by examiner

IONIZATION MASS SPECTROMETRY METHOD AND MASS SPECTROMETRY DEVICE USING SAME

TECHNICAL FIELD

The present invention relates to an ionization mass spectrometry method and mass spectrometry device using the same.

BACKGROUND ART

As demand for analytical methods for quickly analyzing components contained in samples in the field such as food safety, drug quality control, medical diagnosis, environmental analysis, forensic medicine, explosive detection, rapid detection of a chemical/biological agent, mass spectrometry (MS) for various field detection has been developed.

For example, mass spectrometry using an ambient ionization method is appropriate to be developed as mobile equipment because a sample may not be preprocessed or may be directly analyzed in the field by simply preparing the sample. Since desorption electrospray ionization (DESI) and direct analysis in real time ionization method were developed, a mass spectrometer using an ionization method combined with various other principles have been developed. The ambient ionization method may be divided into two groups: spray-based ionization and plasma-based ionization.

The spray-based ionization method has ionization characteristics similar to electrospray ionization (ESI), and DESI is a typical ionization method. Since polyvalent ions are easily produced, the spray-based ionization method has an advantage in that it is able to analyze various materials ranging from a low molecular weight compound with a small molecular weight to a biopolymer such as protein. However, since a solvent is used and the solvent is injected in the form of liquid particles to an introduction part of the mass spectrometer, possibilities of contamination of the introduction part and a reduction in ion signals due to a matrix effect during ionization may not be excluded.

The plasma-based ionization has ionization characteristics similar to atmospheric pressure chemical ionization (APCI), and DART ionization method is a typical plasma-based ionization method. Specifically, metastable chemical species or primary ions produced by plasma produces gaseous reagent ions for ionizing a material, and the gaseous reagent ions ionize a material present on a surface or a vaporized material. The plasma-based ionization is mainly advantageous for ionization of materials which generate monovalent ions and are well vaporized. Since the plasma-based ionization does not use a solvent or uses a minimum amount, if ever, the plasma-based ionization has an advantage as an ionization method of field detection equipment for directly analyzing a sample without preprocessing, but it is disadvantageous in that ionizable components are limited. In particular, since it is difficult to detect a component with low volatility, it may widen a detection range by developing various methods for heating a surface of a sample, but a fundamental limitation has not overcome. The plasma-based ionization method includes a plasma assisted desorption ionization (PADI), dielectric barrier discharge ionization (DBD), flowing atmosphere-pressure afterglow (FAPA), low temperature plasma (LTP), and the like. The plasma-based ionization method exhibits different characteristics according to whether DC or AC plasma power is used, a voltage and a frequency of discharged power, design of an electrode and a plasma device, and a type and a flow rate of a plasma gas, but it has only an effect of partial heating based on plasma illustrating a relatively high temperature in a portion but has difficulty in analyzing a component with low volatility.

DISCLOSURE

Technical Problem

An object of the present invention is to provide a mass spectrometry device capable of detecting components of various samples and detecting samples at various sites, regardless of location.

Specifically, an object of the present invention is to improve ionization characteristics and efficiency of a mass spectrometry device using a conventional plasma ionization method and is to provide a mass spectrometry device, having characteristics of being ionized in both cation and anion modes, capable of analyzing a component, which is mainly detected only in the cation mode in the related art, also in the anion mode.

Another object of the present invention to provide a mass spectrometry device having an expanded range of detecting components with less volatility.

Technical Solution

In one general aspect, a mass spectrometry device includes: a sample seating part including an ultrasonic vibrator having a through hole through which liquid particles formed by the ultrasonic vibrator from an adsorbent material including a sample and a solvent are discharged, the adsorbent material being seated on the ultrasonic vibrator; a reaction part in which plasma or an ionization medium generated by plasma come into contact with the liquid particles discharged from the through hole to form an ionized material; an introduction part discharging and introducing the ionized material to a detection part; and the detection part analyzing the ionized material discharged from the introduction part.

In an embodiment of the present invention, the mass spectrometry device of the present invention is not limited within the scope of achieving the object of the present invention, but liquid particles may be formed from the adsorbent material by vibration of the ultrasonic vibrator and introduced to the reaction part through the through hole.

In an embodiment of the present invention, the mass spectrometry device of the present invention is not limited within the scope of achieving the object of the present invention but it may further include: a plasma supply part supplying plasma or an ionization medium generated by plasma to the reaction part; and a connection part connecting the reaction part and the supply part.

In another general aspect, a mass spectrometry method includes: a) forming liquid particles by applying ultrasonic waves to a mixture containing a sample and a solvent or an adsorbent material with the mixture absorbed thereto; b) bringing plasma or an ionization medium generated by plasma into contact with the liquid particles to generate an ionized material; and c) analyzing the ionized material.

In an example of the present invention, in operation (a), the liquid particles may be formed by the ultrasonic vibrator from the mixture or the adsorbent material with the mixture absorbed thereto and discharged from the through hole on the ultrasonic vibrator, and the liquid particles in operation b) may be liquid particles discharged from the through hole.

In an embodiment of the present invention, in the mixture containing the sample and the solvent or the adsorbent material with the mixture absorbed thereto in operation a), which is not limited within the scope in which the object of the present invention may be achieved, the kind of solvent may be changed or a different kind of solvent may be added according to the lapse of the analysis time and may be sequentially analyzed over time.

Advantageous Effects

According to the exemplary embodiment of the present invention, the mass spectrometry device may detect components of various samples by converting a sample into liquid particles using ultrasonic waves and applying plasma, and may detect a sample in various fields, regardless of location.

Specifically, since the mass spectrometry device of the present invention has characteristics of being easily ionized in both cation and anion modes, a component, which is detected mainly only in the cation mode in the related art, may also be analyzed as an anion.

Also, the mass spectrometry device of the present invention has an effect of expanding a range for detecting components with less volatility.

Further, since the mass spectrometry device of the present invention may convert a sample into liquid particles even at a voltage (5 V) of about a USB power source, the mass spectrometry device may be reduced in size and used for field detection, regardless of location, together with plasma ionization.

BEST MODE

Figure 1:
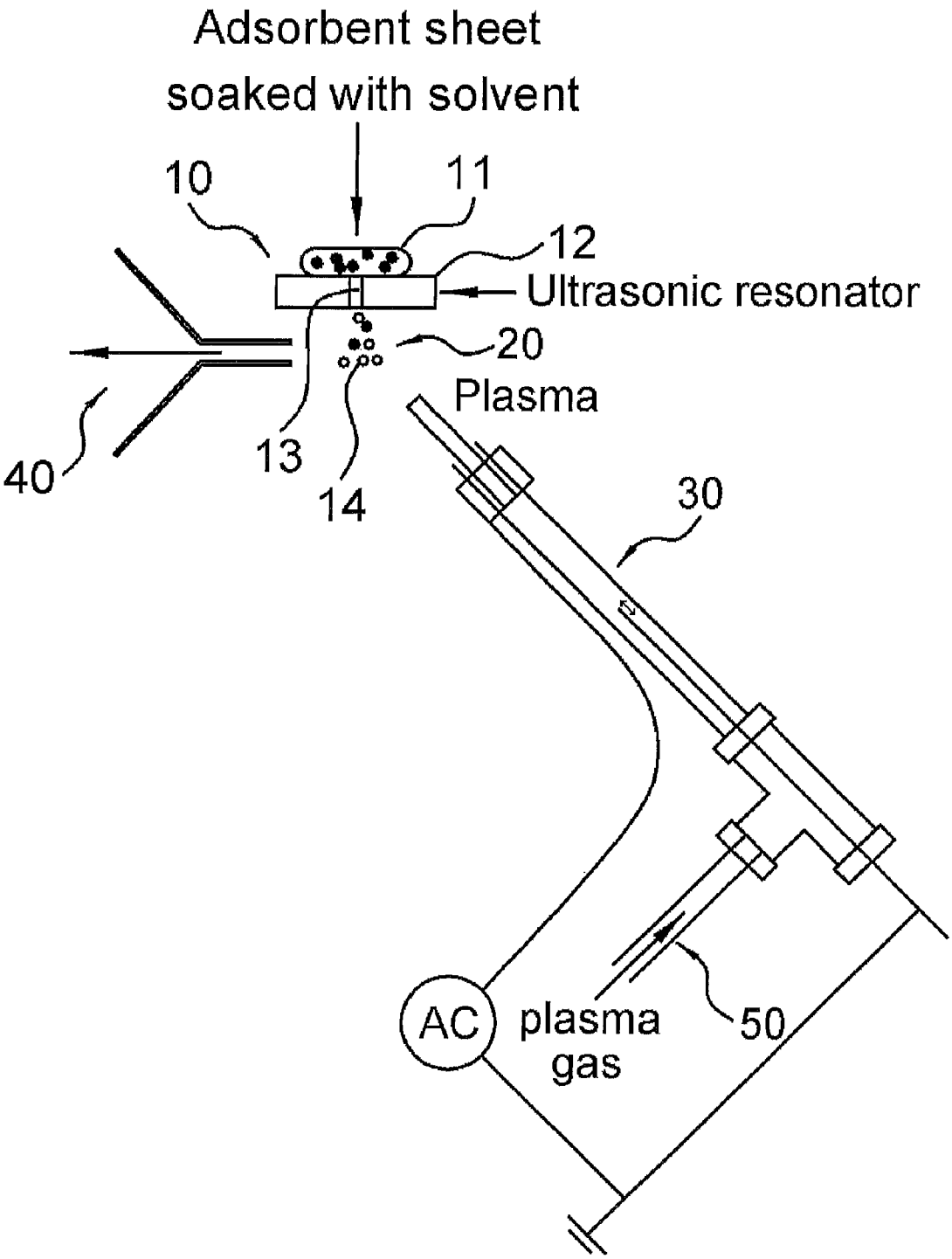
FIG. 1 is a view illustrating a basic example of a mass spectrometry device according to the present invention.

Hereinafter, an ionization mass spectrometry method and mass spectrometry device using the same according to the present invention will be described in detail with reference to the accompanying drawings.

Also, the drawings presented hereinafter are provided as examples to sufficiently transmit the technical concept of the present invention. Thus, the present invention is not limited to the drawings presented hereinafter and may be embodied in a different form, and the drawings present hereinafter may be exaggerated to be illustrated to clarify the technical concept of the present invention.

In addition, unless otherwise defined, technical terms and scientific terms used in the present invention have the same meaning as commonly understood by a person skilled in the art to which the present invention pertains and a description of known functions and components that may unnecessarily obscure the subject matter of the present invention will be omitted.

Unless otherwise stated in the present invention, the unit of % used unclearly means % by weight.

Liquid particles mentioned in the present invention may refer to liquid particles converted by ultrasonic waves from a sample or a mixture including a sample and a solvent, and preferably, refers to fine liquid particles.

Also, the sample mentioned in the present invention may prefer to a general sample, and preferably, refers to a sample which may be converted into liquid particles by ultrasonic waves. Specifically, the sample may refer to a general liquid sample or a solid sample, and may include a sample surface with a solvent, a swipe material including a solvent used for wiping a sample surface, or the swipe material wet in a solvent.

The present invention provides a mass spectrometry device which applies ultrasonic waves to a sample to convert the sample into liquid particles (fine liquid particles) by very fine vibrations to form an ionized material by interaction (contact) with plasma or an ionization medium generated by plasma and analyze the formed ionized material using a mass spectrometer, or the like. That is, the present invention provides an effect of detecting a component of various samples by converting the sample into liquid particles and analyzing the same and detecting a sample in various fields, regardless of location.

Hereinafter, the present invention will be described in detail.

The present invention provides a mass spectrometry device including a sample seating part including an ultrasonic vibrator having a through hole through which liquid particles formed by the ultrasonic vibrator from an adsorbent material including a sample and a solvent (or an adsorbent sheet soaked with solvent) are discharged, the adsorbent material being seated on the ultrasonic vibrator; a reaction part in which plasma or an ionization medium generated by plasma come into contact with the liquid particles discharged from the through hole to form an ionized material; an introduction part (or an MS inlet) introduction part discharging and introducing the ionized material to a detection part; and the detection part analyzing the ionized material discharged from the introduction part.

In an example of the present invention, the ultrasonic vibrator may be a vibrator which may be vibrated by an ultrasonic wave generated by an ultrasonic resonator, and the ultrasonic vibrator may have a structure on which the adsorbent material is seated as illustrated in FIGS. 1 to 4.

In an example of the present invention, the adsorbent material may not be limited and any material may be used as long as it may adsorb a sample, and may include any one or two or more selected from natural fiber and synthetic fiber. For example, the adsorbent material may be filter paper, or the like.

In an embodiment of the present invention, the mass spectrometry device of the present invention is not limited within the scope of achieving the object of the present invention, but liquid particles may be formed and introduced to the reaction part through the through hole from the adsorbent material by vibration of the ultrasonic vibrator.

In an example of the present invention, the adsorbent material is not limited within the scope of achieving the object of the present invention, but it may be one which is seated on a position where the through hole of the vibrator is formed. In a specific example, as the adsorbent material is seated on the position where the through hole is formed, the liquid particles may be formed more effectively.

In an example of the present invention, the amount of the through holes is not limited as long as liquid particles are produced.

In an example of the present invention, a diameter of the through hole is not limited as long as liquid particles are produced, but it may be 0.01 to 5 mm, and preferably 0.1 to 2 mm. When the above range is satisfied, liquid particles may be formed more effectively to detect components of various samples, and samples may be detected in various fields, regardless of location.

In an embodiment of the present invention, the mass spectrometry device of the present invention may further include: a plasma supply part supplying plasma or an ionization medium generated by plasma to the reaction part; and a connection part connecting the reaction part and the supply part.

For example, the connection part is not limited within the scope of achieving the object of the present invention, but it may be a probe having a tubular structure, and any structure may be used as long as it allows the ionized material to flow therein.

In an embodiment of the present invention, the plasma ionization device is not limited and may be a flowing atmospheric-pressure afterglow (FAPA), low temperature plasma (LTP), a dielectric barrier discharge ionization (DBDI), or the like, for example.

In an example of the present invention, the plasma ionization device may be, but is not limited to, various apparatuses using alternating current, direct current, or alternating current and direct current power.

In an embodiment of the present invention, the mass spectrometry device of the present invention is not limited within the scope of achieving the object of the present invention, but preferably, it may allow liquid particles to move from the sample seating part to the reaction part by flow of plasma or the ionization medium generated by plasma. This is illustrated in FIGS. 1 to 3.

In the example of the present invention, the reaction part is not limited within the scope of achieving the object of the present invention, but a contact angle in the reaction part formed by a traveling direction of the liquid partial and a traveling direction of plasma or the ionization medium generated by plasma may be 90 to 180°. This is illustrated in FIGS. 1 to 4.

In an embodiment of the present invention, the reaction part is not limited within the scope of achieving the object of the present invention, but a contact angle in the reaction part formed by a traveling direction of the ionized material formed in the reaction part and a traveling direction of plasma or the ionization medium generated by plasma (traveling direction of plasm) may be 0 to 180°. This is illustrated in FIGS. 1 to 4.

Figure 2:
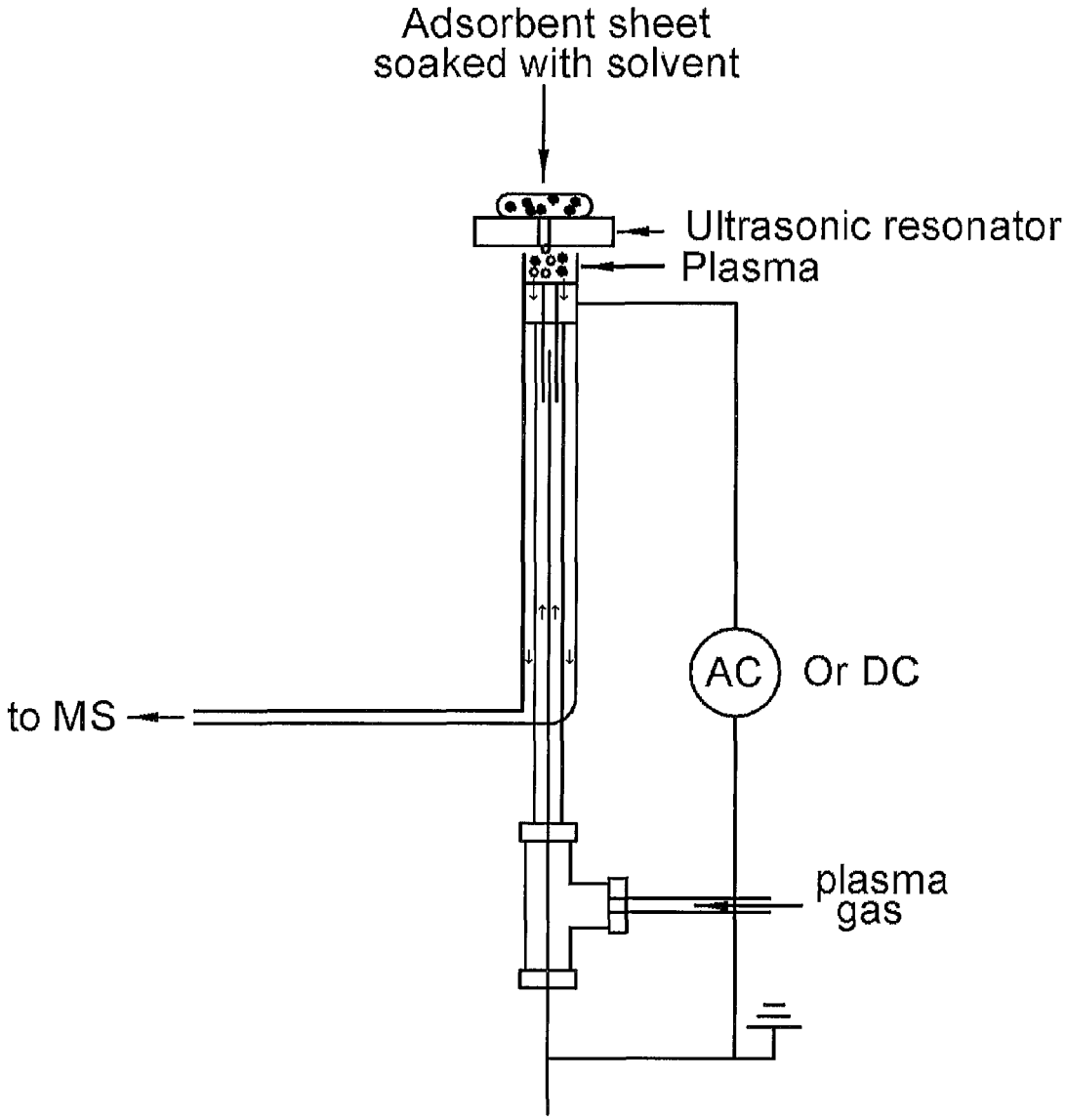
FIG. 2 is a view illustrating an example of a mass spectrometry device of the present invention including a probe having a dual-tube structure.
Figure 3:
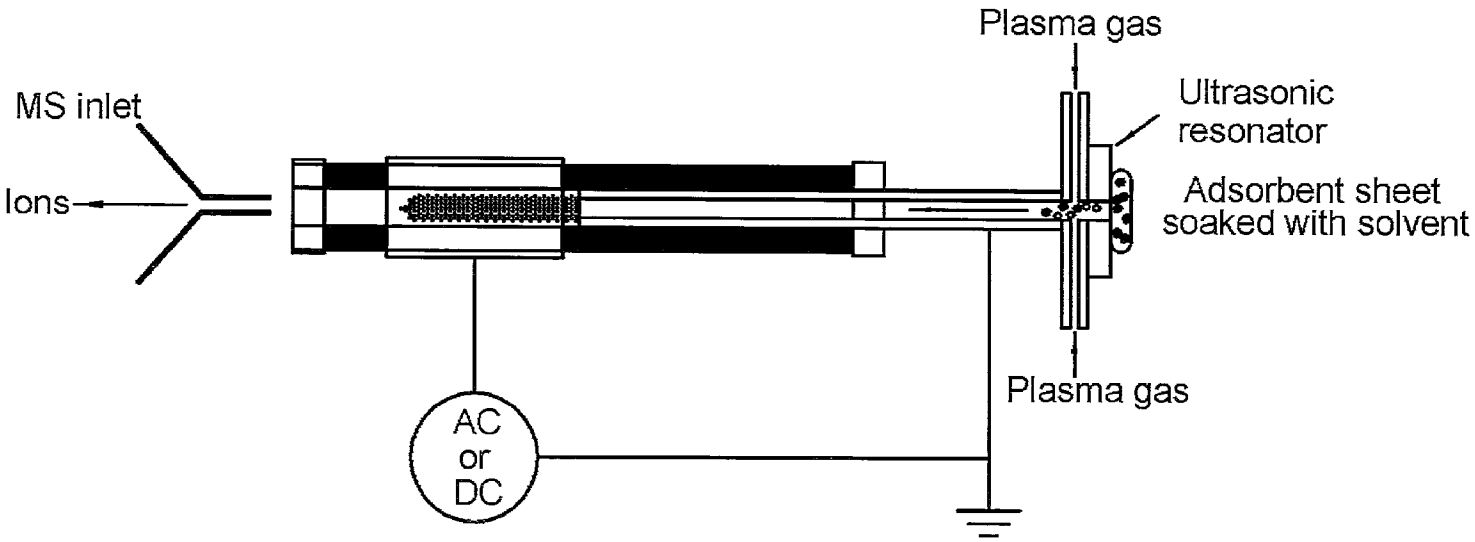
FIG. 3 is a view illustrating an example of a mass spectrometry device according to the present invention having a structure in which liquid particles and plasma are in contact with each other by flow of a plasma gas.

In a specific example, in case where the contact angle formed by the traveling direction of the ionized material formed in the reaction part and the traveling direction of plasma or the ionization medium generated by plasma is 120° close to 180° to 180°, the connection part including the plasma ionization device may be manufactured as a probe having a dual-tubular structure as illustrated in FIG. 2 and may have a structure devised such that liquid particles discharged from the through holes of the ultrasonic vibrator may be ionized by plasma generated in the probe in which a plasma gas flows and introduced to the detection part so that the traveling direction of the liquid particles or the traveling direction of plasma is the same.

In a specific example, in case where the contact angle formed by the traveling direction of the ionized material formed in the reaction part and the traveling direction (plasma traveling direction) of plasma or the ionization medium generated by plasma is 30° close to 90° to 90°, it may be a structure for ionizing the liquid particles as the liquid particles pass through the inside of a tube in which plasma is generated due to flow of a plasma gas (plasma traveling direction) as illustrated in FIG. 3. In such a case, since less vaporized liquid particles pass through the inside of the plasma generation apparatus, more energy may generally be required, and thus, in some cases, more power than that generally used in LTP may be required.

Figure 4:
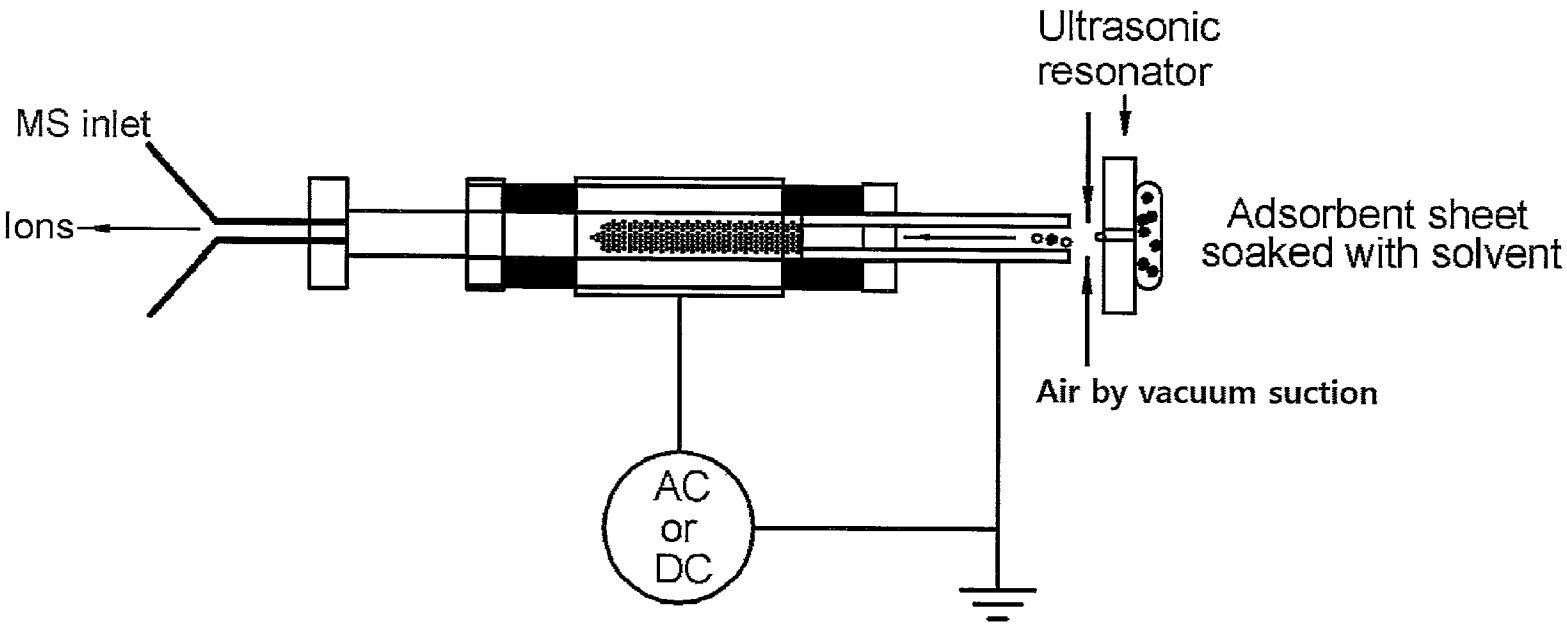
FIG. 4 is a view illustrating an example of a mass spectrometry device according to the present invention having a vacuum suction structure.

In an embodiment of the present invention, the mass spectrometry device of the present invention is not limited within the scope of achieving the object of the present invention, but it may be a mass spectrometry device in which the liquid particles may be moved from the sample seating part to the reaction part by vacuum suction. As illustrated in FIG. 4, according to this structure, flow of air is formed in the reaction part by a vacuum suction effect of an introduction part of the detection part and plasma is directly generated therefrom, eliminating the necessity of separate plasma gas supply. In the case of the structure, since the seating part having a through hole is positioned near the region where plasma is generated, the liquid particles generating flow of air in the reaction part or the seating part may be introduced to the inside of a plasma tube and ionized by the plasma.

In an example of the present invention, the ion signal analyzed in the mass spectrometer may be changed according to the relative positions of the ultrasonic vibrator and the LTP probe with respect to an ion introduction part of the mass spectrometer.

Also, the present invention also provides a mass spectrometry method of converting a liquid sample containing an organic substance into liquid particles, ionizing the liquid particles by various plasma ionization methods, and qualitatively or quantitatively analyzing the liquid particles by mass spectrometry.

Specifically, the mass spectrometry method of the present invention may include: a) forming liquid particles by applying ultrasonic waves to a mixture containing a sample and a solvent or an adsorbent material with the mixture absorbed thereto; b) bringing plasma or an ionization medium generated by plasma into contact with the liquid particles to generate an ionized material; and c) analyzing the ionized material.

In a specific example, a sample may be made into fine liquid particles using ultrasonic waves and then interacted with plasma (e.g., plasma at 1,000° C. or lower) to ionize the components (preferably organic components) contained in the fine liquid particles, and the ionized components are detected by the mass spectrometer. Through the mass spectrometry of the present invention based on this method, various components may be qualitatively and quantitatively analyzed more efficiently. Specifically, it is possible to analyze low-volatility components, which were difficult to ionize in the related art plasma ionization method, and also, unlike the conventional plasma ionization method in which the anion is observed only in a very small amount of components such as nitro compounds, and the like, and components are mainly ionized as the cation, an organic acid and a simple fatty acid may be detected as the anion. Since anion detection may minimize chemical noise due to other components, it is advantageously effective for on-site detection where analysis must be performed in a complex environment without a simple sample pretreatment.

In the present invention, operation (a) is not limited within the scope in which the object of the present invention may be achieved, but, in operation (a), the liquid particles may be formed by the ultrasonic vibrator from the mixture or the adsorbent material with the mixture absorbed thereto and discharged from the through hole on the ultrasonic vibrator, and the liquid particles in operation b) may be liquid particles discharged from the through hole. When the sample passes through the through hole by the ultrasonic vibration, the sample is converted into the liquid particles and thereafter comes into contact with plasma or the ionization medium generated by plasma in operation b) to produce an ionized material. When the mass of the produced ionized material is analyzed, remarkably various components may be ionized and detected, compared with the related art case in which the sample itself is simply ionized. In particular, it is possible to analyze even less volatile components and analyze in the anion mode with low chemical noise, and thus, accuracy may be enhanced and the range of the analytical substance may be broadened due to the excellent ionization characteristics even in the field detection where complex samples are handled.

Figure 5:
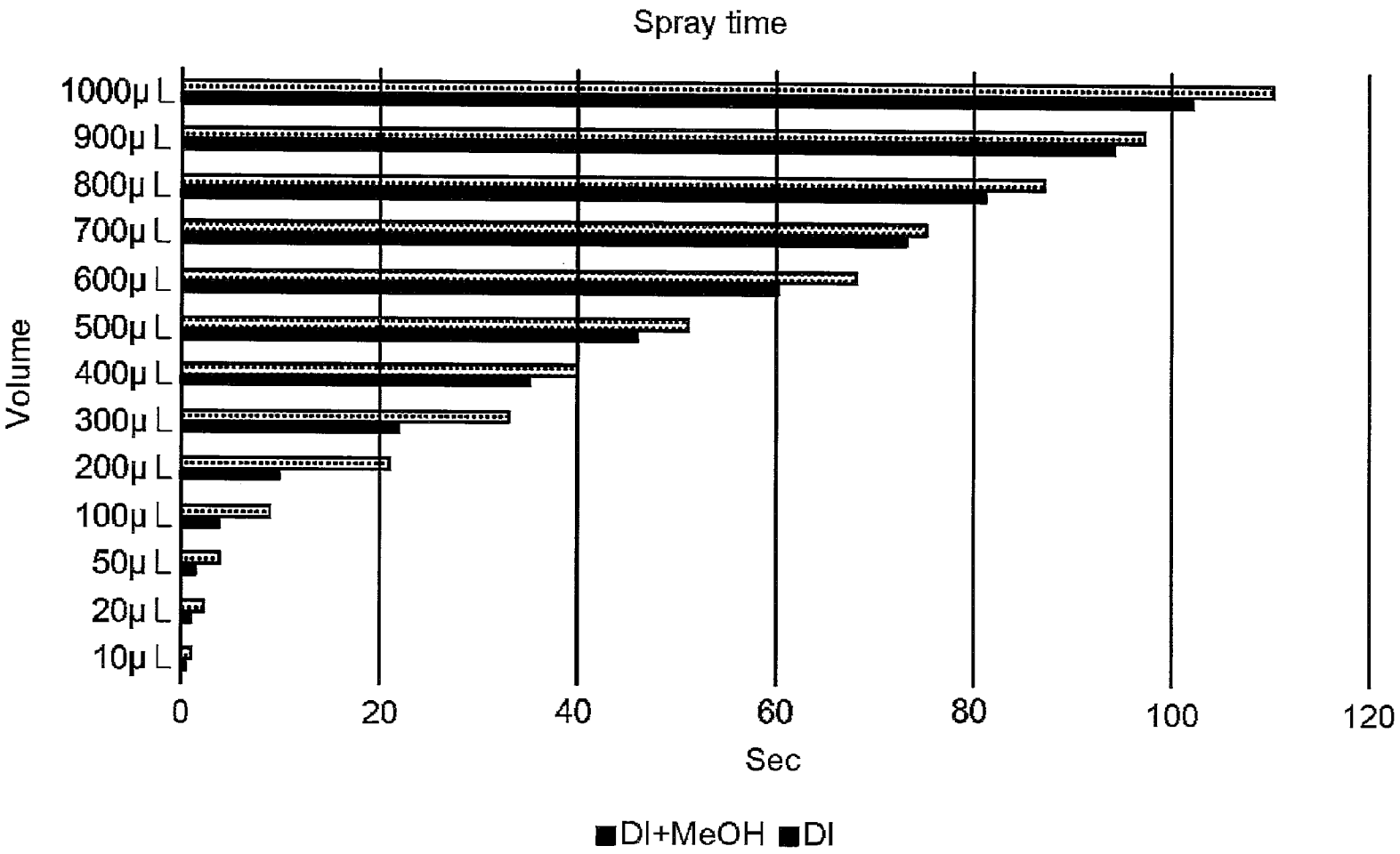
FIG. 5 is data illustrating a liquid particle generation and holding time according to collected amounts of a sample solution.

In an embodiment of the present invention, a generation and holding time of the liquid particles is not limited within the scope in which the object of the present invention may be achieved, but it may be controlled according to sample amounts (collected amounts of sample solution). The generation and holding time of the liquid particles according to sample amounts is illustrated in FIG. 5 as an example.

In an embodiment of the present invention, the solvent is not limited within the scope in which the object of the present invention may be achieved but it may include any one or two or more selected from water, methanol, ethanol, hexane, and chloroform. Such a solvent is not limited and may be appropriately selected according to solubility and ionization of the sample component.

In an embodiment of the present invention, in the mixture containing the sample and the solvent or the adsorbent material with the mixture absorbed thereto in operation a), the kind of solvent may be changed or a different kind of solvent may be added according to the lapse of the analysis time. That is, the same sample may be sequentially analyzed with different solvents over time. Specifically, since different solvents may be appropriate for solubility and ionization according to samples, the kinds of solvents may be changed or different kinds of solvents may be further added for effective analysis. Here, the kind of solvent may be changed or a different kind of solvent may be added during a non-continuous analysis process, and analysis may be performed in real time even during a continuous analysis process.

An example of performing the mass spectrometry of the present invention will be described below.

An ultrasonic vibrator is installed so that fine liquid particles produced in the ultrasonic vibrator may be generated near an introduction part of the mass spectrometer for LC-MS. Next, a plasma apparatus is installed so that plasma from the LTP plasma ion source or metastable atoms generated from the plasma pass through the fine liquid particles generated in the ultrasonic vibrator and move toward the introduction part of the mass spectrometer. Thereafter, filter paper prepared by wetting a liquid sample and a liquid specimen is put on the ultrasonic vibrator, plasma is generated in the plasma ion source, and the ultrasonic vibrator is operated so that fine liquid particles are formed from the sample and ionized. The thusly formed ionized material is analyzed qualitatively or quantitatively using the mass spectrometer, or the like.

In an example of the present invention, in case where a different kind of sample or a new sample is analyzed, it is desirable to clean the ultrasonic vibrator or to replace the absorbent material with a new one for more precise analysis. However, this is a desirable example and the present invention is not limited thereto.

Hereinafter, the present invention will be described in detail with reference to Examples. However, Examples are provided to explain the present invention in more detail and the scope of the present invention is not limited by the Examples below.

Inventive Example 1

An ultrasonic vibrator driven at 2 W was installed at a position 1 cm distant from the entrance of the vacuum inlet of the mass spectrometer. Thereafter, the LTP ionization device was positioned as illustrated in FIG. 1 so that fine liquid particles generated in the ultrasonic vibrator may interact with plasma of the LTP ionization device. Thereafter, the sample and circular filter paper having a diameter of 1 cm or less in which the sample and ethanol were absorbed was put on a liquid sample seating part of the ultrasonic vibrator. A time for generating and holding the fine liquid particles according to the collected amount of sample solution is illustrated in FIG. 5.

Subsequently, an AC voltage of a few kHz and a few kV was applied to the LTP ionization device and He was applied as a plasma gas to generate plasm, and a position was adjusted so that plasma is applied to a portion from which fine liquid particles were to be produced by the ultrasonic vibrator and discharged. Thereafter, power of the ultrasonic vibrator was turned on to generate fine liquid particles, and the fine liquid particles were interacted with plasma to ionize analysis target components contained in the liquid particles.

Thereafter, a mass spectrometer (LTQ linear ion trap, Thermo) was used to analyze the ionized target components (ionized materials) using a general electrospray ionization device. Specifically, a detection method was set so as to obtain a mass spectrum in a scan mode in the range of m/z 50-1000. The results are illustrated in Table 1 below and FIGS. 7 to 9.

TABLE 1

| Compound | M.W | V.P (mm/Hg at 25□) | Positive mode | Negative mode | Normal LTP |
|---|---|---|---|---|---|
| Pyruvic acid | 88.1 | 0.968 | ○ | ○ | None |
| Alanine | 89.1 | $1.05 \times 10^{-7}$ | ○ | ○ | None |
| L− (+) −Lactic acid | 90.1 | 0.0813 | ○ | ○ | None |
| Fumaric acid | 116.1 | $1.54 \times 10^{-4}$ | None | ○ | None |
| Valine | 117.2 | $5.55 \times 10^{-9}$ | ○ | ○ | None |
| Oxaloacetic acid | 132.1 | Unknown | ○ | ○ | None |
| L− () −Malic acid | 134.1 | $1.28 \times 10^{-4}$ | ○ | ○ | None |
| Glutamic acid | 147.1 | $5.19 \times 10^{-7}$ | ○ | ○ | None |
| Fructose | 180.2 | Unknown | None | ○ | None |
| Glucose | 180.2 | Unknown | None | ○ | None |
| Citric acid | 192.1 | 11.16 | ○ | ○ | (+) mode |
| Capric acid ethyl ester | 200.3 | $3.1 \times 10^{-2}$ | ○ | None | (+) mode |

TABLE 1-continued

| Compound | M.W | V.P (mm/Hg at 25□) | Positive mode | Negative mode | Normal LTP |
|---|---|---|---|---|---|
| Tryptophan | 204.2 | $2.1 \times 10^{-9}$ | None | ○ | None |
| Ibuprofen | 206.3 | $4.74 \times 10^{-5}$ | ○ | ○ | (+) mode |
| Lauric acid ethyl ester | 228.4 | $7.44 \times 10^{-3}$ | ○ | None | (+) mode |
| Melatonin | 232.3 | $1.4 \times 10^{-7}$ | ○ | None | None |
| Pentadecanoic acid | 242.4 | Unknown | None | ○ | None |
| Myristic acid ethyl ester | 256.4 | $1.57 \times 10^{-3}$ | ○ | None | (+) mode |
| Palmitic acid | 256.4 | $3.8 \times 10^{-7}$ | None | ○ | None |
| D-glucose 6-phosphate | 260.1 | 0 | ○ | None | None |
| D-fructose 6-phosphate | 260.1 | 0 | ○ | None | None |
| Linoleic acid | 280.5 | $8.68 \times 10^{-7}$ | ○ | ○ | None |
| Ethyl palmitate | 284.3 | Unknown | ○ | None | (+) mode |
| Palmitic acid ethyl ester | 284.5 | $7.0 \times 10^{-5}$ | ○ | None | (+) mode |
| Stearic acid ethyl ester | 312.5 | $3.01 \times 10^{-5}$ | ○ | None | (+) mode |
| Arachidic acid | 312.5 | Unknown | None | ○ | None |
| Arachidic acid ethyl ester | 340.6 | Unknown | ○ | None | (+) mode |
| Behenic acid ethyl ester | 368.6 | $5.42 \times 10^{-7}$ | ○ | None | (+) mode, heating |
| Ethyl tetracosanoate | 396.7 | Unknown | ○ | None | (+) mode, heating |

As illustrated in Table 1, it can be seen that, the mass spectrometry device or mass spectrometry according to Inventive Example 1 using plasma ionization utilizing fine liquid particles generated based on ultrasonic waves can analyze even less volatile components (compared with the related art using LTP ionization such as in Comparative Example 1), expanding the range of analytical target materials, and the components analyzable as an anion were also significantly expanded.

In Comparative Example 1, in the case of fatty acids, a cation was detected only in case of esterification, and in case where volatility was low, the cation was rarely observed unless a sample was heated. However, in the case of using plasma ionization utilizing the production of fine liquid particles according to Inventive Example 1, the fatty acid could be easily observed as an anion without any treatment.

Comparative Example 1

Figure 6:
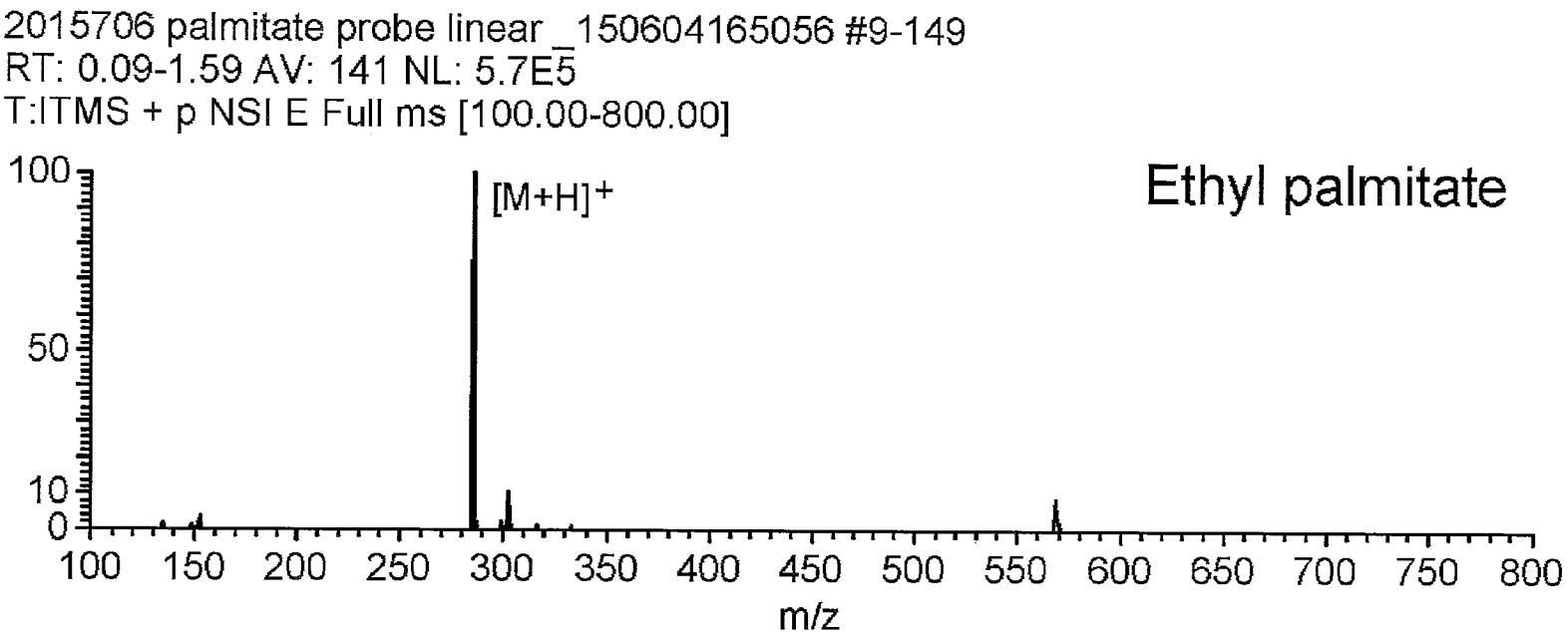
FIG. 6 is data obtained by detecting a sample using the conventional low temperature plasma (LTP) ionization method (apparatus) according to Comparative Example 1.

The same sample as that of Inventive Example 1 was analyzed by a general LTP ionization method in which fine liquid particles produced in an ultrasonic vibrator were not in contact with (or interacted with) plasma. The results are illustrated in FIG. 6. Specifically, instead of the ultrasonic vibrator, a sample prepared by raising a solution on a slide glass and drying the solution was used.

As illustrated in FIG. 6, it can be seen that, in the case of ethyl palmitate, sensitivity of Inventive Example 1 was detected to be 10 times higher than that of Comparative Example 1.

Figure 7:
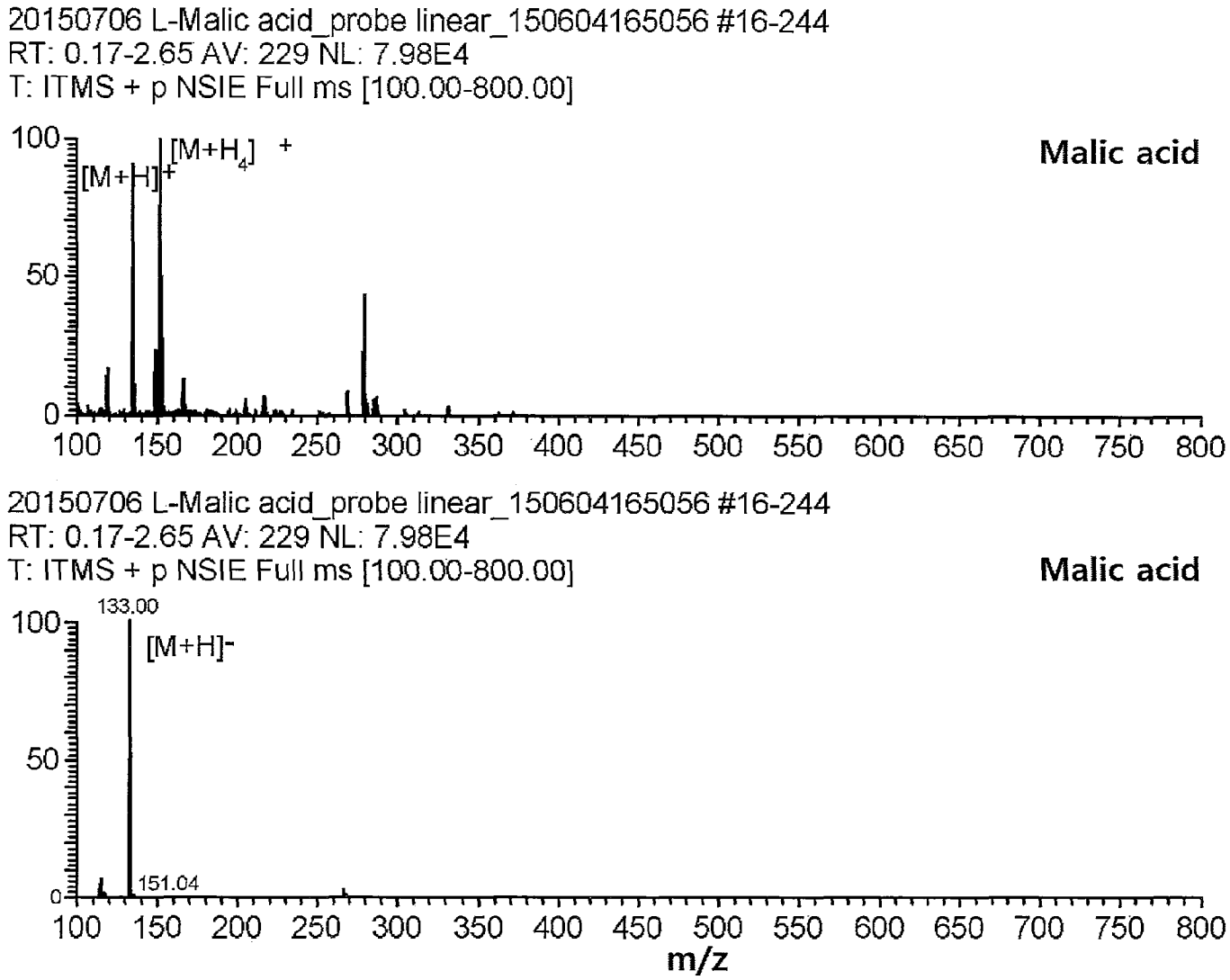
FIGS. 7 to 9 are data obtained by detecting a sample using the mass spectrometry (mass spectrometry device) of the present invention according to Inventive Example 1.
Figure 8:
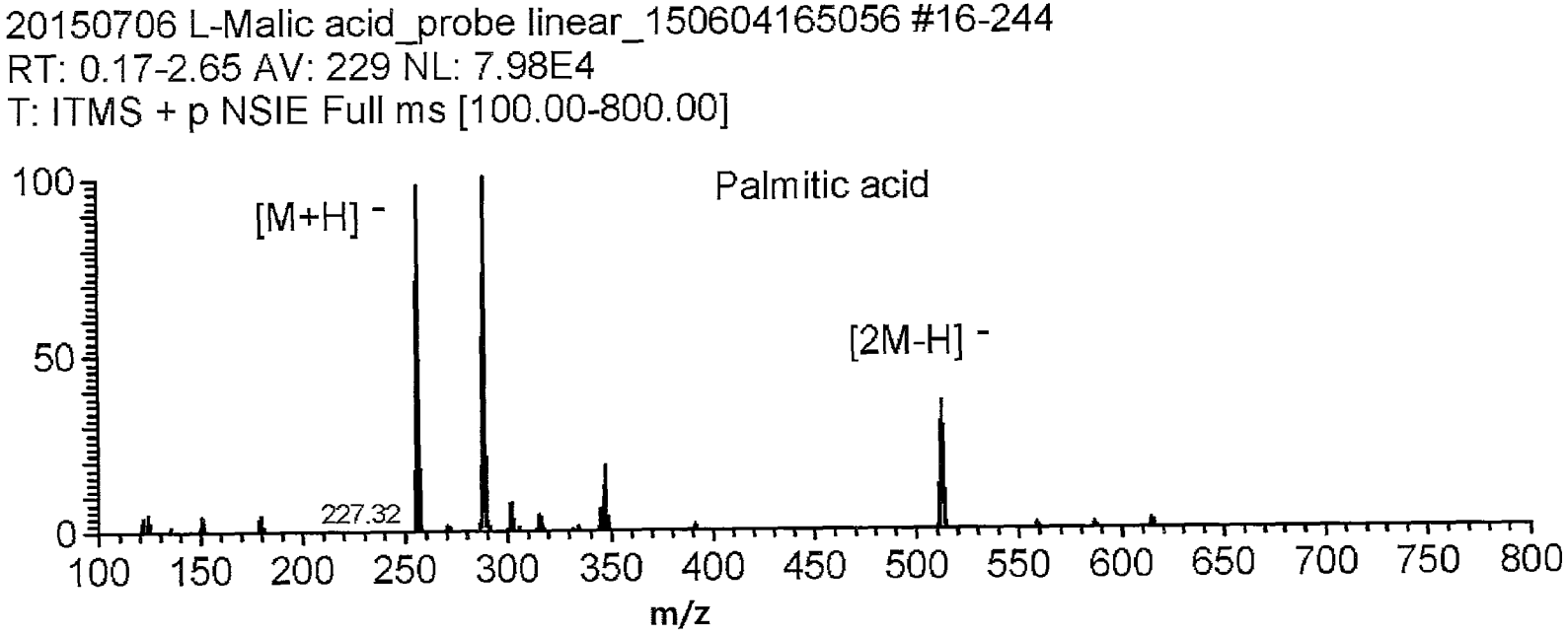
Figure 9:
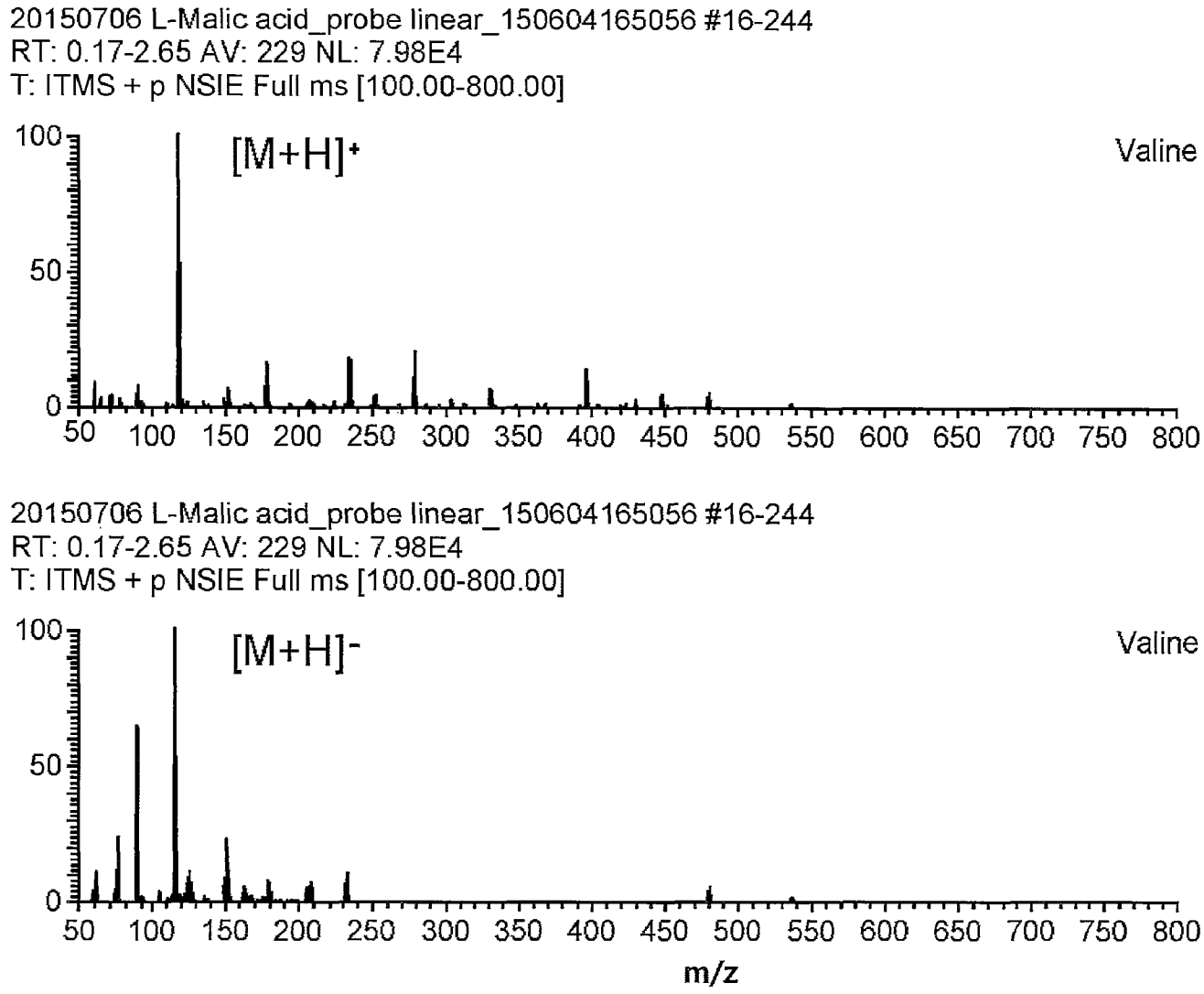

As illustrated in FIGS. 7 to 9, it can be seen that, organic acids, fatty acids, and amino acids, which were not detected by the related art LTP method of Comparative Example 1, are also well observed even as anions in the case of Inventive Example 1.

As described above, according to the present invention, since the fine liquid particles by the ultrasonic waves (by the vibrator) are ionized by plasma, even more various chemical components may be ionized and detected, compared with the case of simply ionizing a sample itself in the related art. In particular, since a component with less volatility can be analyzed and analysis may be performed even in an anion mode with less chemical noise during mass spectrometry, it is possible to improve precision by the excellent ionization characteristic even in field detection handling complex samples and an analyzable material range may be significantly expanded.

The technical concept of the present invention must not be confined to the explained embodiments, and the following claims as well as everything including variations equal or equivalent to the claims pertain to the category of the thought of the present invention.

DESCRIPTION OF REFERENCE NUMERAL

10: seating part
11: adsorbent material
12: ultrasonic vibrator
13: through hole
14: ionized material
20: reaction part
30: connection part
40: introduction part
50: plasma supply part

The invention claimed is:

1. A mass spectrometry system device comprising:

a wipe material containing a solvent and configured for wiping a sample-containing surface to provide a sample-containing wipe material containing the solvent and a sample from the sample-containing surface; and a mass spectrometry device comprising an ultrasonic vibrator a reaction part, an introduction part, and a mass spectrometric detection part, wherein the ultrasonic vibrator comprises a top surface, a bottom surface and a through hole interconnecting the top surface and the bottom surface, wherein the top surface comprises a sample seating portion including a top opening of the through hole such that the sample-containing wipe material is placed over the top opening when the sample-containing wipe material is placed on the sample seating portion, wherein the ultrasonic vibrator is configured to vibrate to generate liquid particles of the sample from the sample-containing wipe material such that at least part of the liquid particles generated from the sample-containing wipe material over the top opening travel through the through hole to under the ultrasonic vibrator;

wherein the reaction part is located under the ultrasonic vibrator, in which plasma or an ionization medium is applied to the liquid particles of the sample to form an ionized material;

wherein the introduction part is configured to send the ionized material to a mass spectrometric detection part; and wherein the mass spectrometric detection part is configured to analyze the ionized material.

2. The mass spectrometry system of claim 1, wherein a diameter of the through hole is 0.1 to 2 mm.

3. The mass spectrometry system of claim 1, further comprising:

a plasma supply part configured to supply plasma or an ionization medium to the reaction part; and a connection part connecting the reaction part and the plasma supply part.

4. The mass spectrometry system of claim 3, wherein the liquid particles are to be moved from the sample seating portion to the reaction part by vacuum suction.

5. The mass spectrometry system of claim 3, wherein the liquid particles are to be moved from the sample seating portion to the reaction part by flow of plasma or an ionization medium generated by plasma.

6. A mass spectrometry method comprising:

providing a mass spectrometry device comprising a ultrasonic vibrator having a top surface, a bottom surface, and a through hole interconnecting the top surface and the bottom surface:

providing a wipe material containing a solvent;

wiping a sample-containing surface with the wipe material to provide a sample-containing wipe material;

placing the sample-containing wipe material on the top surface such that the sample-containing wipe material is placed over a top opening of the through hole;

running the ultrasonic vibrator to generate liquid particles of a sample from the sample-containing wipe material such that at least part of the liquid particles generated from the sample-containing wipe material over the top opening travel through the through hole to under the ultrasonic vibrator;

applying plasma or an ionization medium to the liquid particles under the ultrasonic vibrator to generate an ionized material; and analyzing the ionized material.

7. The mass spectrometry method of claim 6, wherein a diameter of the through hole is 0.1 to 2 mm.

8. The mass spectrometry method of claim 6, wherein the plasma has a temperature equal to or less than 1,000° C.

9. The mass spectrometry method of claim 6, further comprising adding, to the sample-containing wipe material, another solvent which is different from the solvent.

10. The mass spectrometry system of claim 1, wherein the plasma has a temperature equal to or less than 1,000° C.

* * * * *